US006547236B1

(12) United States Patent
Yip et al.

(10) Patent No.: US 6,547,236 B1
(45) Date of Patent: Apr. 15, 2003

(54) PICK-UP MECHANISM AND A METHOD FOR PERFORMING A PICK-UP CYCLE IN A REPRODUCTION MACHINE

(75) Inventors: Kok Sam Yip, Singapore (SG); Pui Wen Huang, Singapore (SG); Ching Yong Chua, Singapore (SG); Choon Siang Peck, Singapore (SG)

(73) Assignee: Hewlett-Packard Company, Palo Alto, CA (US)

( * ) Notice: Subject to any disclaimer, the term of this patent is extended or adjusted under 35 U.S.C. 154(b) by 140 days.

(21) Appl. No.: 09/703,452

(22) Filed: Oct. 31, 2000

(30) Foreign Application Priority Data

Jan. 5, 2000 (SG) ..... 200000007-5

(51) Int. Cl.[7] ..... B65H 3/06

(52) U.S. Cl. ..... 271/115; 271/114; 271/118; 271/127

(58) Field of Search ..... 271/109, 114, 271/115, 117, 118, 126, 127

(56) References Cited

U.S. PATENT DOCUMENTS 5,697,603 A * 12/1997 Kato ..... 271/114
5,984,297 A * 11/1999 Tanaka ..... 271/118
5,992,993 A * 11/1999 Kiyohara et al. ..... 347/104
6,000,689 A * 12/1999 Furuki et al. ..... 271/10.11
6,070,867 A * 6/2000 Tsurumi et al. ..... 271/114
6,416,050 B1 * 7/2002 Niikura ..... 271/127
6,422,773 B1 * 7/2002 Lim ..... 400/710
6,443,445 B1 * 9/2002 Bortolotti ..... 271/117

* cited by examiner

*Primary Examiner*—Christopher P. Ellis
*Assistant Examiner*—Patrick Mackey

(57) ABSTRACT

A pick-up mechanism and a method for performing a pick-up cycle in a reproduction machine. The pick-up mechanism comprises a pick-up control pinion which is firmly coupled to a control cam, and a drive gearing including a first rocker driving gear and a second rocker driving gear. The first and second rocker driving gears are mounted to a rocker device to be alternately engaged into and disengaged from, respectively, the pick-up control pinion. Upon starting the pick-up operation, the second rocker driving gear is drivingly engaged into a toothed section of the pick-up control pinion, and, in the course of the pick-up operation, the first rocker driving gear is drivingly engaged into the toothed section of the pick-up control pinion.

9 Claims, 5 Drawing Sheets

PICK-UP MECHANISM AND A METHOD FOR PERFORMING A PICK-UP CYCLE IN A REPRODUCTION MACHINE

BACKGROUND OF THE INVENTION

The present invention relates to a pick-up mechanism of a reproduction machine, such as a printing machine or a copier, especially of a wide-format printing machine, for controlling a pick-up cycle, and a method for performing a pick-up cycle in a reproduction machine.

Hereinafter, the invention will be described in the context of a wide-format printer in which a spring-biased pressure plate and a cam are used. Nevertheless, it is to be understood that it is equally applicable to other reproduction machines such as copiers, or other pick-up mechanisms.

In general, known printers use a spring-biased pressure plate and a cam to control the timing during the pick-up cycle of a pick-up mechanism for picking up a printing medium, such as a sheet of paper or transparency. A separate gearing mechanism is used to control the activation of the pick-up cycle by engaging with a main driving mechanism of the printer. The purpose of the spring-biased pressure plate and the cam is to allow media to come into contact with and to be fed by a pick-up roller in a timely cycle, and to allow a user to load media into an input tray of the printer between the pick-up roller and the pressure plate by creating a clearance therebetween.

FIGS. 1 and 2 show a gearing mechanism using the reverse pick-up concept to activate the pick-up cycle, as illustrated in a known printer, HP® DJ 1000, available from Hewlett-Packard Company, USA. The gearing mechanism comprises a control pinion 1 and a control cam 2 having a driving face 3 and a driven face 4, respectively, engageable with each other. The control cam 2 is in contact with a spring-biased pressure plate (not shown) to move the plate into a lower position (i.e. a position remote from the pick-up roller) and a raised position (i.e. a position closer to the pick-up roller) for engaging and disengaging a pick-up roller with/from a medium, respectively. The disadvantage of the reverse pick-up gearing mechanism is that the control pinion 1 has no total control on the movement of the control cam 2 during a complete pick-up cycle. When the pressure plate is about to rise up from its lowest position in the pick-up cycle, the upward force from the biased spring of the pressure plate causes the control cam to rotate at an uncontrolled speed being higher than the normal pick-up speed, since there is nothing to restrict the rotation of the control cam 2. The gearing mechanism is thus unable to receive the turning force of the control cam and disengage itself from the pick-up mechanism. This causes the pressure plate to rise up and hit, directly or, if medium is loaded, through the medium, like a paper stack, the pick-up roller uncontrollably at high speed, thus creating loud noises.

SUMMARY OF THE INVENTION

An object of the present invention is to provide a pick-up mechanism for controlling a pick-up cycle, and a method for performing a pick-up cycle in a reproduction machine, wherein noises are substantially reduced and the pick-up mechanism is able to pick-up the media at higher speed, thereby increasing throughput.

According to the present invention, the pick-up mechanism has a pick-up control pinion which is firmly coupled to a control cam, and a drive gearing including a first rocker driving gear and a second rocker driving gear which are mounted to a rocker device to be alternately engaged into and disengaged from, respectively, the pick-up control pinion. Upon starting the pick-up operation, the second rocker driving gear is drivingly engaged into a toothed section of the pick-up control pinion, and, in the course of the pick-up operation, the first rocker driving gear is drivingly engaged into the toothed section of the pick-up control pinion.

By arranging the rocker device it is possible to wholly control the rotation of the pick-up control pinion such that the movement of the pick-up control cam is also controlled during the whole pick-up cycle. The movement of the pick-up control pinion is controlled in a defined manner for the reason that the first and second rocker driving gear are alternately engaged into and, accordingly, alternately disengaged from the pick-up control pinion.

The above and other objects, features and advantages of the present invention will become apparent from the following description and the appended claims, taken in conjunction with the accompanying drawings in which like parts or elements are denoted by like reference signs.

DETAILED DESCRIPTION OF THE INVENTION

A preferred embodiment of the present invention will now be described with reference to the attached drawings.

Figure 2:
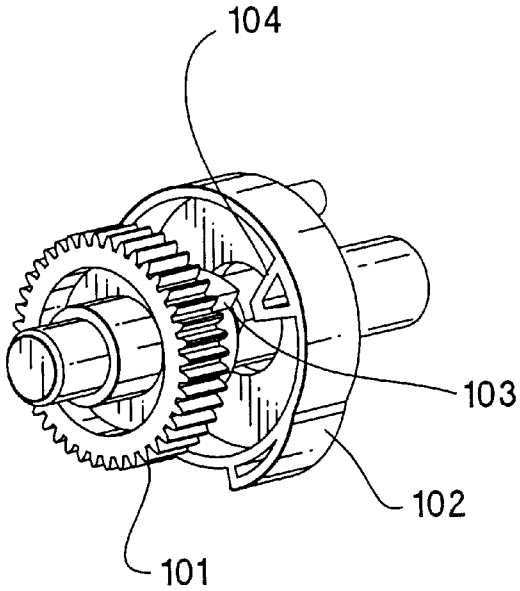
Fig. 2 (PRIOR ART)
FIG. 2 is an exploded perspective view of the gearing mechanism of FIG. 1.
Figure 1:
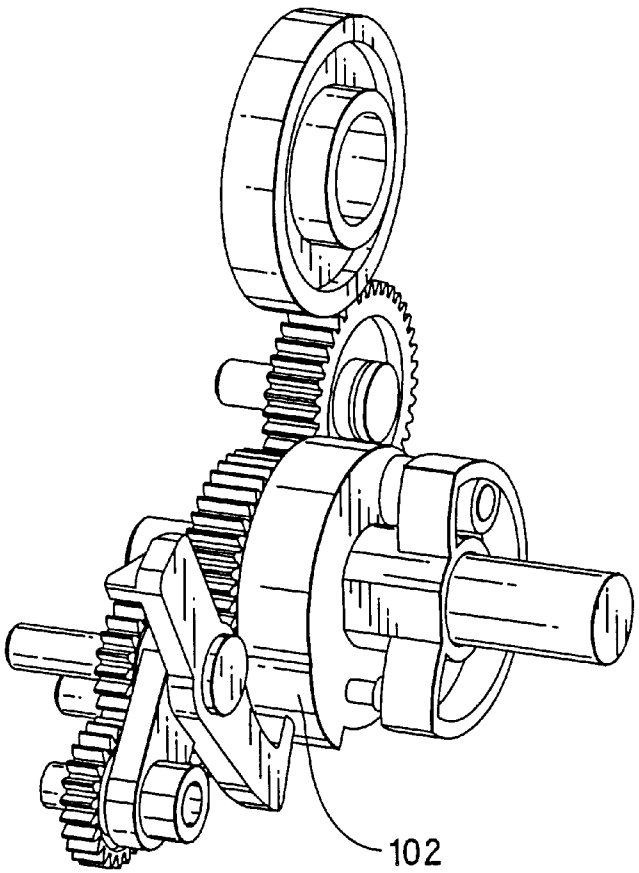
Fig. 1 (PRIOR ART)
FIG. 1 is a perspective view of a gearing mechanism of a wide-format printing machine according to the prior art.
Figure 3:
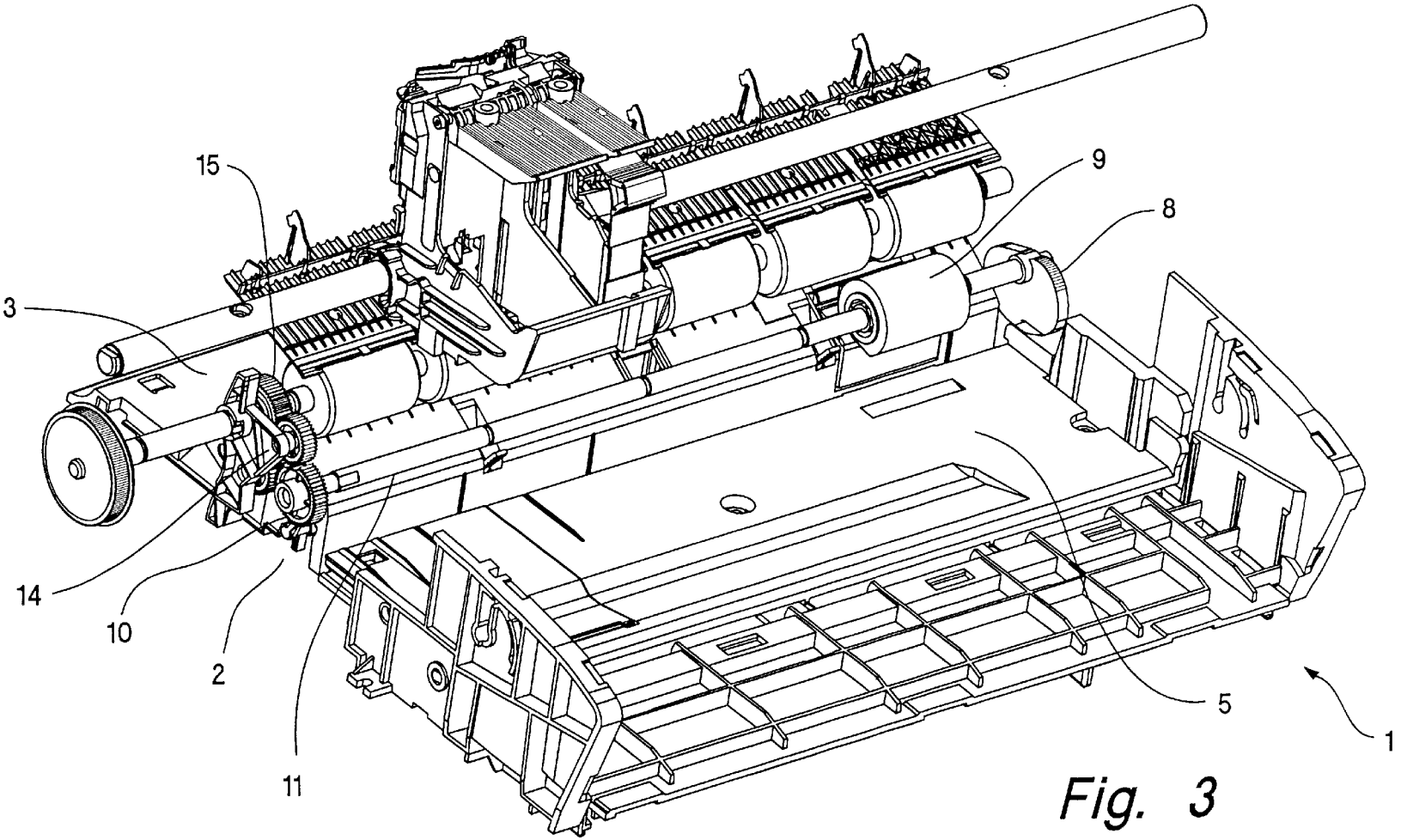
FIG. 3 is a perspective view showing the location and interaction between different parts of a pick-up mechanism of a printing machine according to the present invention.
Figure 4:
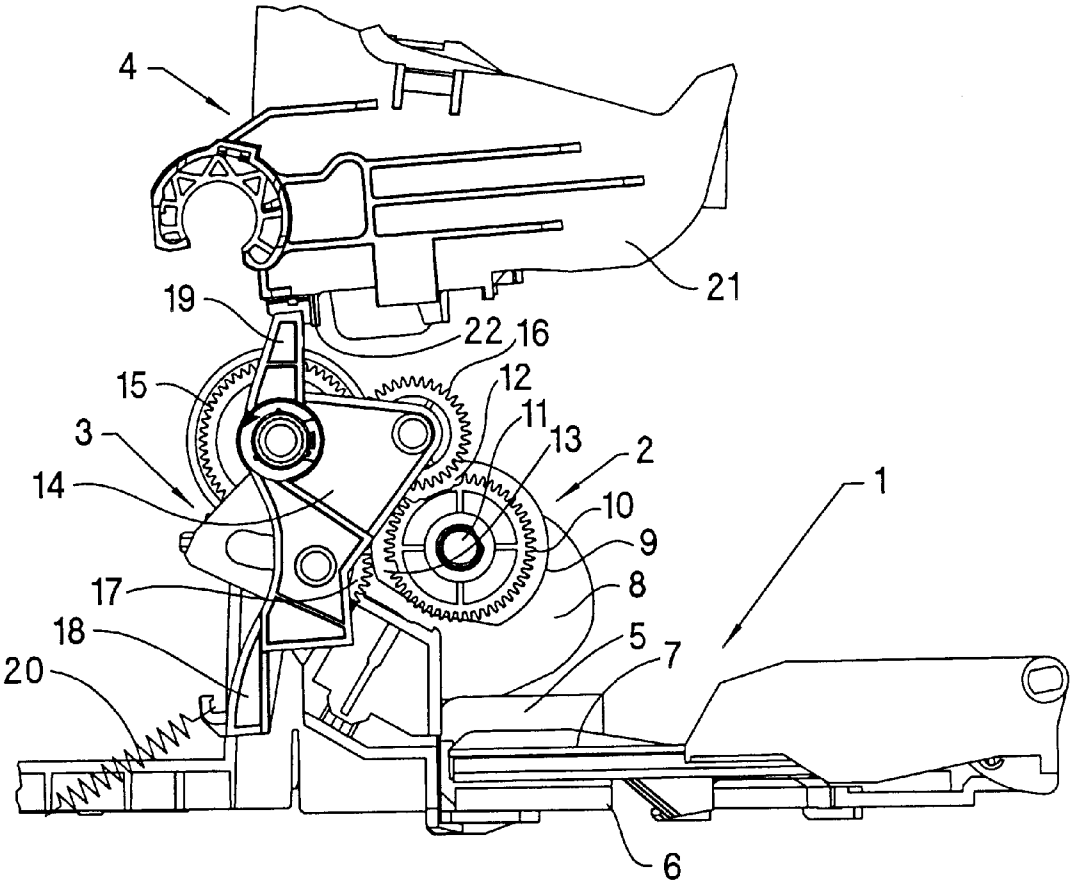
FIG. 4 is a schematic side view of the pick-up mechanism of FIG. 3 with a carriage cradle interacting with the pick-up mechanism, shown in a non-driven condition in a printing operation.

FIG. 3 shows the location of and interaction between different parts of a pick-up mechanism of a printing machine according to the present invention. As shown in FIGS. 3 and 4, the pick-up mechanism generally comprises an input section 1, a driven section 2, a driving section 3 and an actuating section 4.

The input section 1 includes a pressure plate 5 biased by a spring 6 in upward direction, and a paper stacking 7 from which sheets are to be picked up for a printing operation.

The driven section 2 includes a pick-up control cam 8, a pick-up roller 9 and a pick-up control pinion 10, which are all firmly coupled to a common shaft 11. A recessed toothless zone 12 and a small engaging recess 13 are formed at the circumferential surface of the pick-up control pinion 10 at a distance from each other in circumferential direction. The pick-up control cam 8 of the driven section 2 is in contact with the pressure plate 5 of the input section 1 to control the upward and downward movement of the pressure plate 5 and thereby the engagement and disengagement between the pick-up roller 9 and the paper stacking 7.

The driving section 3 includes a rocker plate 14 which rotatably carries a drive gear 15, a first rocker driving gear 16 and a second rocker driving gear 17 in a triangle-shaped arrangement to each other, and is pivotable around the axis of the drive gear 15 engaged with the main driving mechanism of the printing machine. The first and second rocker driving gears 16, 17 are rotatably engaged with the drive gear 15 and can be alternately engaged with (and disengaged from) the pick-up control pinion 10 by pivoting the rocker plate 14. The rocker plate 14 has a first leg 18 and an opposite second leg 19, wherein the rocker plate 14 is biased by a spring 20 via the first leg 18 in a direction such that the first rocker driving gear 16 is engaged with the pick-up control pinion 10, and is actuatable via the second leg 19 by the actuating section 4 against the force of the spring 20 in a direction such as to engage the second rocker driving gear 17 with the pick-up control pinion 10. For this purpose, the actuating section 4 includes a carriage cradle 21 provided with an actuating surface 22 contacted with the second leg 19 of the rocker plate 14, and is controlled by the printing mechanism.

Next, the operation of the pick-up mechanism is explained with reference to FIGS. 5 to 8.

Figure 5:
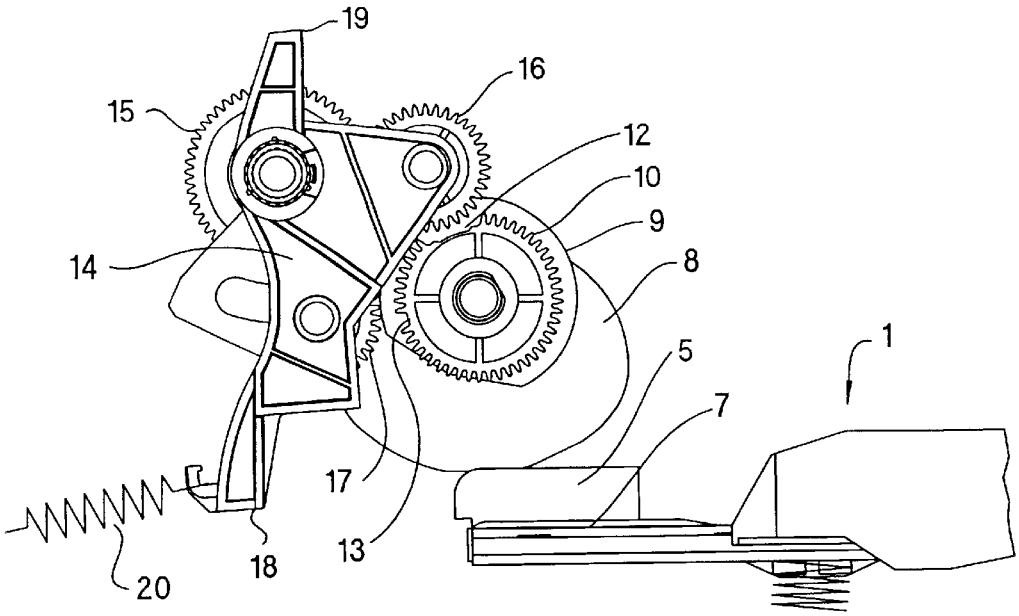
FIG. 5 is a schematic side view of the pick-up mechanism of FIG. 4 shown in a non-driven condition in a printing operation.

As shown in FIG. 5, the pick-up control cam 8, which is in contact with the pressure plate 5, is in a non-driven condition when no pick-up operation is executed, for example, during a printing operation or stand-by state of the printer, wherein the pressure plate 5 is pressed down by the pick-up control cam 8 and is in the lower position, i.e. in the most remote position from the pick-up roller 9 defined by the profile of the pick-up control cam 8. In this lower position of the pressure plate 5, the paper stacking 7 can be loaded into the input section I between the pressure plate 5 and the pick-up roller 9. In this non-driven condition of the pick-up mechanism, the first rocker driving gear 16 is idly engaged into the recessed toothless zone 12 of the pick-up control pinion 10, so that the pick-up control pinion 10 is held in its position, even if the first rocker driving gear 16 is rotated by the drive gear 15 in the printing operation. Therefore, the pick-up mechanism is not activated in this condition.

Figure 6:
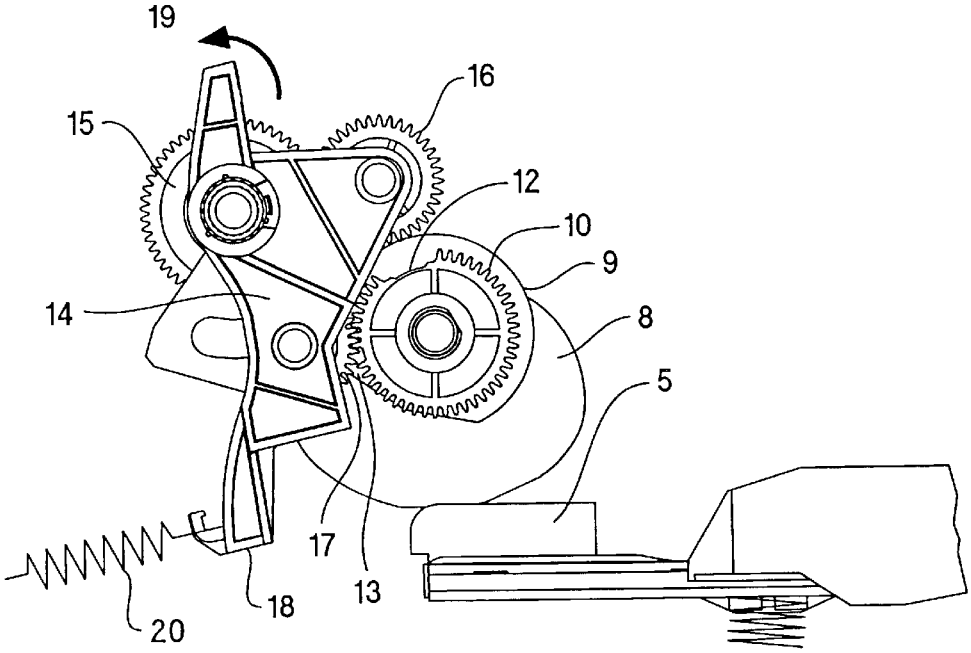
FIG. 6 is a schematic side view of the pick-up mechanism of FIG. 4 shown in starting a first stage of a driven condition in a pick-up operation.

FIG. 6 shows the pick-up mechanism in starting a first stage of a driven condition in a pick-up operation. The rocker plate 14 is activated via its second leg 19 by the actuating surface 22 of the carriage cradle 21 against the biasing force of the spring 20, when the carriage cradle 21 moves back to its pick-activating position after a printing cycle is finished. Thereby, the rocker plate 14 is rotated anti-clockwise to engage the second rocker driving gear 17 with the engaging recess 13 of the pick-up control pinion 10 while disengaging the first rocker driving gear 16 from the recessed toothless zone 12 of the pick-up control pinion 10. The engaging recess 13 of the pick-up control pinion 10 allows a secure engaging of the teeth of the second rocker driving gear 17 with the teeth of the pick-up control pinion 10, secures a suitable backlash therebetween, and prevents the teeth of the second rocker driving gear 17 from striking against the teeth of the pick-up control pinion 10 during the engaging phase thereof.

Figure 7:
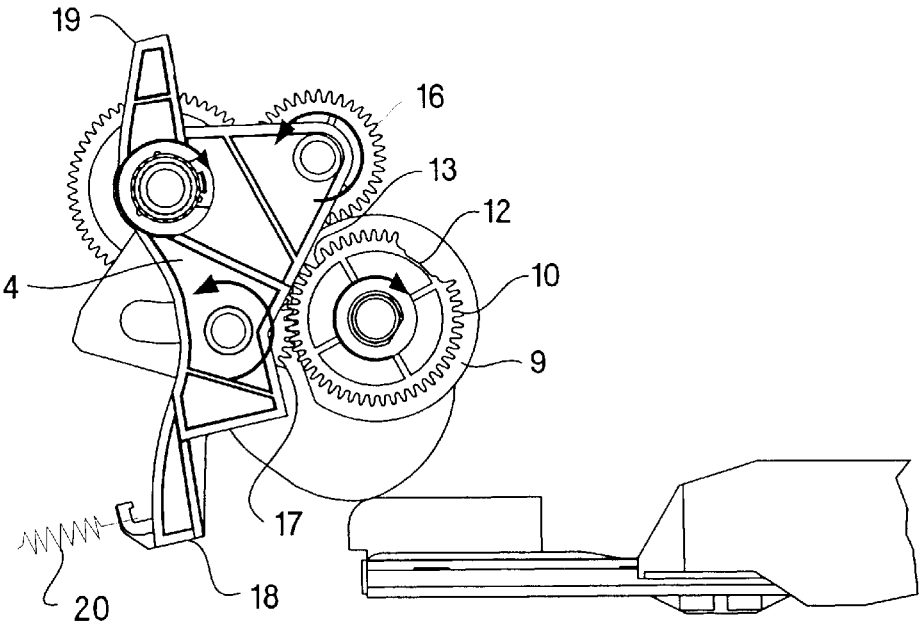
FIG. 7 is a schematic side view of the pick-up mechanism of FIG. 4 shown in terminating the first stage of the driven condition in the pick-up operation.

Once the pick-up control pinion 10 is driven by the second rocker driving gear 17, the pressure plate 5 will be raised in a controlled manner according to the profile of the pick-up control cam 8. FIG. 7 shows the pick-up mechanism in terminating the first stage of the driven condition in the pick-up operation wherein the pressure plate is about to rise up.

Subsequently, in the course of the pick-up operation, when the activation of the rocker plate 14 by the actuating surface 22 of the carriage cradle 21 is terminated and thereby the rocker plate 14 is rotated by the force of the spring 20 in a clockwise direction, the first rocker driving gear 16 is drivingly engaged with the pick-up control pinion 10 while the second rocker driving gear 17 is disengaged from the pick-up control pinion 10. The transition period from disengaging the second driving gear 17 from the pick-up control pinion 10 to engaging the first driving gear 16 with the pick-up control pinion 10 takes a non-interrupted course, so that an interruption of the movement of the pick-up control pinion 10 and a change of the rotation speed thereof are prevented. In this transition period the teeth of the first and second rocker driving gears 16, 17 are incompletely engaged with the teeth of the pick-up control pinion 10 until the first rocker driving gear 16 is completely engaged with the pick-up control pinion 10 when the rocker plate 14 rotates in a clockwise direction.

Figure 8:
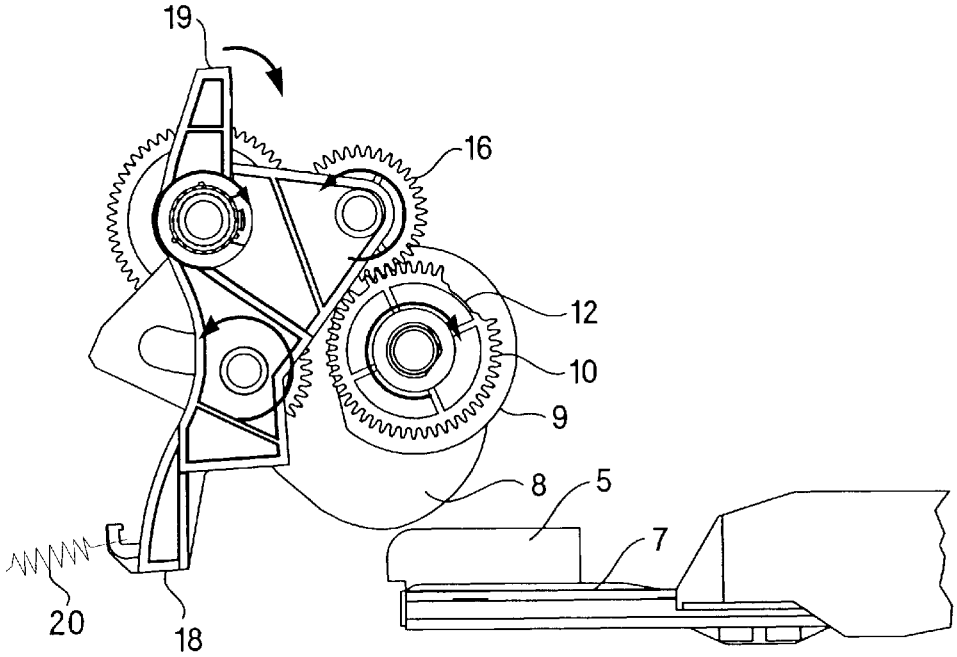
FIG. 8 is a schematic side view of the pick-up mechanism of FIG. 4 shown in starting a second stage of the driven condition in the pick-up operation.

FIG. 8 shows the pick-up mechanism in starting a second stage of the driven condition in the pick-up operation, wherein the first rocker driving gear 16 is completely engaged with the pick-up control pinion 10. The pick-up control pinion 10 is driven by the first rocker driving gear 16 and rotated until this latter comes into the recessed toothless zone 12 of the pick-up control pinion 10 into the idly engaging condition, and therefore the pick mechanism stops at this position. This causes the pick-up control cam 8 to control the pressure plate 5 such that it is moved from the lower position into a raised position and finally again into the lower position, wherein the paper sheets of the paper stacking 7 are contacted by and pressed to the pick-up roller 9 and picked up by the same in the raised position of the pressure plate 5. The pick-up operation is terminated by idly engaging the first rocker driving gear 16 into the recessed toothless zone 12 of the pick-up control pinion 10. In this idly engaging condition, the printing operation can be carried out again until the next pick-up operation is started. By performing the second stage of the driven condition in the pick-up operation, the pick-up cycle is completed and it is ensured that the pick-up mechanism activates one cycle, wherein the movement of the pick-up control cam 8 is securely controlled during the entire pick-up operation with a constant rotation speed.

Accordingly, the method of the invention comprises the steps of firmly coupling the control cam to a pick-up control pinion, providing an idly engaging condition in the non-driven conditions of the control cam by idly engaging the pick-up control pinion by a first driving gear, upon starting the pick-up operation, drivingly engaging the pick-up control pinion by a second driving gear while disengaging the first driving gear, in the course of the pick-up operation, drivingly engaging the pick-up control pinion by the first driving gear while disengaging the second driving gear, and terminating the pick-up operation by rotating the first driving gear into the idly engaging condition.

Therefore, the method to prevent the pressure plate from rising uncontrollably is implemented by a two stage picking sequence. The first stage involves rotating the pick-up control pinion and the control cam by engaging the pick-up control pinion with the second driving gear while disengaging the first driving gear from its idly engaging condition with the pick-up control pinion. This causes the spring-biased pressure plate to position itself just before it starts to rise up. In the second stage the first driving gear is engaged with the pick-up control pinion while the second driving gear is disengaged from its engaging condition with the pick-up control pinion. This means that the transition period between disengaging the second driving gear from the pick-up control pinion and engaging the first driving gear with the pick-up control pinion takes a non-interrupted course, so that an interruption of the movement of the pick-up control pinion and a change of the rotation speed thereof are prevented.

In other words, the first driving gear prevents the high upward spring force of the spring-biased pressure plate from rotating the control cam in an uncontrolled manner by positively engaging the first driving gear and the pick-up control pinion. The function of the first driving gear is riot only to complete the picking cycle in a controlled manner, but also to ensure that the pick-up mechanism activates one cycle. The first driving gear ends its driving function at the idly engaging condition and therefore the pick-up mechanism stops at this position.

Using this two stages picking sequence, the pick-up mechanism is able to perform the operation at a high speed and on a low acoustic level. The throughput of the printing or copying process in a printing or copying machine using the inventive pick-up method is therefore increased.

The pick-up control pinion can be drivingly engaged by the first driving gear while disengaging the second driving gear therefrom upon starting to move the pressure plate from the raised position into the lower position. This allows a defined movement of the pressure plate not only during its movement from the lower position into the raised position, but also in reverse direction, so that a constant speed of the pick-up control pinion and therefore a constant upward and downward movement of the pressure plate are achieved.

Since the first and second driving gears are alternately engaged into and disengaged from, respectively, the pick-up control pinion by a rocker device, a reliable movement course of the spring-biased pressure plate is achieved.

As shown in connection with the preferred embodiments, the pick-up mechanism has a basic conception as following.

The pick-up mechanism comprises a pick-up control pinion which is firmly coupled to a control cam and to a pick-up roller, and a drive gearing including a first rocker driving gear and a second rocker driving gear. The first and second rocker driving gears are mounted to a rocker device to be alternately engaged into and disengaged from, respectively, the pick-up control pinion. Upon starting the pick-up operation, the second rocker driving gear is drivingly engaged into a toothed section of the pick-up control pinion, and, in the course of the pick-up operation, the first rocker driving gear is drivingly engaged into the toothed section of the pick-up control pinion.

Accordingly, the control cam moves a machine part, such as a spring-biased pressure plate, to be controlled from its lower position through a raised position back into the lower position in the pick-up operation by alternately engaging the first and second rocker driving gears with the toothed section of the pick-up control pinion, respectively, at a constant speed. This prevents the machine part from rising up and hitting the pick-up roller uncontrollably at high speed, so that noises of an impact of the machine portion on the pick-up roller are reduced.

As described in the above embodiment, the pick-up control pinion includes a recessed toothless zone by which the toothed section is interrupted, so that the first rocker driving gear is idly engaged into the recessed toothless zone of the pick-up control pinion when the control cam is in a non-driven condition before starting the pick-up operation.

By arranging the recessed toothless zone for idly engaging the first rocker driving gear, it is possible to control the non-driven condition. Moreover, it is possible to arrange the pick-up operation of the control cam by positively engaging the first and second rocker driving gears with the recessed toothless zone and the toothed section of the pick-up control pinion, respectively.

Therefore, the control cam securely holds a machine part, such as the pressure plate, to be controlled in its lower position when the control cam is in its non-driven condition, i.e. when it is not in the pick-up operation, by idly engaging the first rocker driving gear with the recessed toothless zone of the pick-up control pinion.

In the embodiment above, the rocker device includes a rocker plate carrying a drive gear rotatably engaged with the first and second rocker driving gears. This enables the first and second rocker driving gears to be commonly driven by the drive gear with a constant speed, so that no separate driving mechanism for the first and second rocker driving gears are necessary. Since the drive gear is permanently engaged with the first and second rocker driving gears and is integrated therewith on the rocker plate, it is possible to pivot the entire rocker plate around a predetermined pivot axis for engaging the first and second rocker driving gears with the pick-up control pinion, respectively. The pivot axis of the rocker plate is preferably the rotation axis of the drive gear, but can also be provided at any other location on the rocker plate.

According to the above embodiment, the rocker plate can have first and second legs and can be biased via the first leg by a spring in a direction of engagement of the first rocker driving gear with the pick-up control pinion. Further, the rocker plate can be actuatable via the second leg by a carriage cradle in a direction of engagement of the second rocker driving gear with the pick-up control pinion. By arranging the spring biasing the rocker plate in the direction of engagement of the first rocker driving gear with the pick-up control pinion, a separate actuating device in this direction becomes unnecessary. Therefore, the carriage cradle can have a simple and low-cost structure and can be easily controlled by a control unit for actuating the second leg of the rocker plate in the pick-up operation.

To eliminate problems in engaging the second rocker driving gears with the pick-up control pinion, the pick-up control pinion can have an engaging recess formed in the toothed section. The second rocker driving gears comes into engagement with the pick-up control pinion at the location of the engaging recess in the toothed section of the pick-up control pinion to achieve a secure engaging of the teeth of the second rocker driving gear with the toothed section of the pick-up control pinion and to secure a suitable backlash therebetween. Additionally, the engaging recess in the toothed section prevents the teeth of the second rocker driving gears from striking together with the teeth of the pick-up control pinion during the engaging phase thereof.

In the preferred embodiment, the pick-up control pinion has been turned by an angle of approximately 65 degrees before the first rocker driving gear is drivingly engaged with the pick-up control pinion and just before the pressure plate starts to rise up. This enables the first rocker driving gear to securely hold the turning force of the control cam from the biased pressure plate spring.

While the embodiment is directed to a pick-up mechanism of a wide-format printing machine, the invention can also be used for other printing machines or a copier.

What is claimed is:

1. A pick-up mechanism of a reproduction machine for controlling a sheet media pick-up cycle in which a pick-up control cam is in a driven condition during a pick-up operation, the pick-up mechanism comprising:

a pick-up control pinion which is firmly coupled to the control cam and which includes a toothed section, the control cam being in contact with a spring-biased pressure plate, and a drive gearing drivingly engaged with the pick-up control pinion for controlling rotation of the pick-up control pinion for a rotation substantially without interruption during the whole pick-up cycle, wherein the drive gearing includes a first rocker driving gear and a second rocker driving gear which are continuously driven during the pick-up operation and which are mounted to a rocker device to be alternately engaged into the pick-up control pinion, wherein the rocker device is controlled such that upon starting the pick-up operation, the second rocker driving gear is drivingly engaged into the toothed section of the pick-up control pinion, and, in the course of the pick-up operation, the second rocker driving gear is disengaged from the toothed section of the pick-up control pinion and the first rocker driving gear is drivingly engaged into the toothed section of the pick-up control pinion.

2. A pick-up mechanism according to claim 1, wherein the first and second rocker driving gears both are partly engaged into the toothed section of the pick-up control pinion when disengaging the second rocker driving gear and engaging the first rocker driving gear.

3. A pick-up mechanism according to claim 1, wherein the pick-up control pinion includes a recessed toothless zone by which the toothed section is interrupted, so that the first rocker driving gear is idly engaged into the recessed toothless zone of the pick-up control pinion when the control cam is in a non-driven condition before the pick-up operation is started.

4. A pick-up mechanism according to claim 1, wherein the rocker device includes a rocker plate carrying a drive gear rotatably engaged with the first and second rocker driving gears.

5. A pick-up mechanism according to claim 4, wherein the rocker plate has first and second legs, the rocker plate being biased via the first leg by a spring in a direction of engagement of the first rocker driving gear with the pick-up control pinion, and the rocker plate being actuatable via the second leg by a carriage cradle in a direction of engagement of the second rocker driving gear with the pick-up control pinion.

6. A pick-up mechanism according to claim 1, wherein the pick-up control pinion has an engaging recess formed in the toothed section for securing the engagement of the teeth of the second rocker driving gear with the pick-up control pinion.

7. A method for performing a sheet medium pick-up cycle in a reproduction machine, in which a control cam in contact with a spring-biased pressure plate is driven substantially without interruption through a pick-up operation thereby moving the pressure plate from a lower position through a raised position into the lower position, the pick-up operation being started from and terminated by non-driven conditions of the control cam, wherein the control cam is firmly coupled to a pick-up control pinion, the method further comprising:

idly engaging the pick-up control pinion with a first driving gear in the non-driven conditions of the control cam, upon starting the pick-up operation, drivingly engaging the pick-up control pinion by a second driving gear while disengaging the first driving gear, in the course of the pick-up operation, drivingly engaging the pick-up control pinion by the first driving gear while disengaging the second driving gear, wherein the first and second driving gears both partly engage the pick-up control pinion when disengaging the second driving gear and engaging the first driving gear, and terminating the pick-up operation by rotating the first driving gear into the idly engaging condition.

8. A method according to claim 7, wherein the pick-up control pinion is drivingly engaged by the first driving gear while the second driving gear is disengaged from the pick-up control pinion upon starting to move the pressure plate from the raised position into the lower position.

9. A method according to claim 7, wherein the first and second driving gears are alternately engaged into and disengaged from, respectively, the pick-up control pinion by a rocker device.

* * * * *